US006572514B1

(12) United States Patent
Calafato

(10) Patent No.: US 6,572,514 B1
(45) Date of Patent: Jun. 3, 2003

(54) EXERCISER WITH COUNTER-RECIPROCATING PEDALS

(76) Inventor: Kathleen E. Calafato, 7169 N. Bank Rd., Roseburg, OR (US) 97470

( * ) Notice: Subject to any disclaimer, the term of this patent is extended or adjusted under 35 U.S.C. 154(b) by 0 days.

(21) Appl. No.: 09/457,414

(22) Filed: Dec. 7, 1999

Related U.S. Application Data

(60) Provisional application No. 60/111,622, filed on Dec. 9, 1998.

(51) Int. Cl.[7] ..... A63B 23/08; A63B 23/10

(52) U.S. Cl. ..... 482/79; 482/80

(58) Field of Search ..... 482/75, 79, 80, 482/148

(56) References Cited

U.S. PATENT DOCUMENTS

| | | | | | |
|---|---|---|---|---|---|
| 1,948,534 | A | * | 2/1934 | Nelson et al. | |
| 2,041,693 | A | * | 5/1936 | Boltz et al. | |
| 2,206,902 | A | * | 7/1940 | Kost | |
| 2,573,808 | A | * | 11/1951 | Rovoire | |
| 3,374,782 | A | * | 3/1968 | Izzo | |
| 3,421,760 | A | * | 1/1969 | Freeman | |
| 3,525,522 | A | * | 8/1970 | Piller | 482/80 |
| 4,159,111 | A | * | 6/1979 | Lowth | 272/96 |
| 4,676,501 | A | | 6/1987 | Hoagland et al. | |
| 4,936,573 | A | | 6/1990 | Miller | |
| 4,998,720 | A | * | 3/1991 | Kim | 482/130 |
| 5,230,675 | A | * | 7/1993 | Lin | 482/53 |
| 5,595,557 | A | | 1/1997 | Lambert et al. | |
| 5,628,710 | A | | 5/1997 | Hervig | |
| 5,713,820 | A | | 2/1998 | Carbone | |
| 5,759,136 | A | | 6/1998 | Chen | |
| 5,765,921 | A | * | 6/1998 | Chuang | 297/423.46 |
| 5,772,615 | A | | 6/1998 | Elder et al. | |
| 5,807,212 | A | | 9/1998 | Nelson | |
| 5,984,841 | A | * | 11/1999 | Jphn | 482/79 |

* cited by examiner

*Primary Examiner*—Nicholas D. Lucchesi
*Assistant Examiner*—Lori Baker Amerson
(74) *Attorney, Agent, or Firm*—Kolisch Hartwell, P.C.

(57) ABSTRACT

A frame has a continuous upper surface with a pair of side-by-side elongate openings for receiving foot pedals. Each pedal is hingedly mounted to the frame near the heel. A motor is mounted on the frame for rotating a shaft. A cam is mounted on the shaft for supporting the pedal between the toe and the hinged frame mounting. The cams associated with the pedals extend in radially opposite directions from the shaft so as to produce counter-reciprocating motion in the pedals during shaft rotation. A resistance device, such as a spring, fluid cylinder, shaft brake or motor, provide resistance to downward movement of each pedal during manual operation. One or more switches or other control device is mounted relative to the frame or pedal that is manipulable by a user's foot or hand for controlling operation of the motor.

8 Claims, 7 Drawing Sheets

EXERCISER WITH COUNTER-RECIPROCATING PEDALS

CROSS-REFERENCE TO RELATED APPLICATIONS

This application claims the benefit of U.S. Provisional Application No. 60/111,622, filed Dec. 9, 1998.

STATEMENT REGARDING FEDERALLY SPONSORED RESEARCH OR DEVELOPMENT

Not Applicable.

BACKGROUND OF THE INVENTION

The present invention relates to the field of exercising devices, and in particular to exercising devices that provide counter-reciprocating pedal movement for exercising the feet and legs.

Many lifestyles require sitting for long periods of time. These lifestyles may include working at a desk in an office, watching television, or riding in a motorized vehicle. Muscular atrophy and circulatory retardation are well known health risks faced by many individuals who sit for long periods of time. Since exercise during sitting is typically very limited, it is desirable to use an exercise device that is compact and portable, yet provides the seated person a way to gently exercise the muscles of the lower extremities.

Various devices are known which exercise the lower extremities while the user is seated. These typically involve rotary pedaling, such as is used on a bicycle. One device which provides for reciprocating motion of pedals hingedly connected to a base is described in U.S. Pat. No. 5,765,921 issued to Chuang. This structure has two pedals that support the user's feet. The pedals may be connected together so that they pivot in unison, or may be disconnected so that they pivot freely. This device thus provides a foot rest that may also be used to pivot the feet independently.

There remains the need for a simple exerciser that is small and portable enough to be readily used in an office environment or in confined areas while providing active extending and contracting of muscles of the lower extremities.

BRIEF SUMMARY OF THE INVENTION

The present invention provides for active extending and contracting of muscles of the lower extremities by pedals coupled together in a manner producing counter-reciprocating motion of the pedals.

More specifically, the present invention provides an exerciser having a pair of elongate pedals and a coupler mounted relative to a frame for coupling the pedals in a manner producing opposite, counter-reciprocating motion. The pedals are mounted in side-by-side relationship. Each pedal has a toe end, a heel end, and an upper pedal surface extending along a pedal axis. Each pedal is mounted at a first position to the frame in a manner limiting the pedal to movement about a pivot axis. The coupler supports each of the pedals at a second position spaced from the first position and moves the second position of the pedal upwardly when the second position of the other pedal moves downwardly. The coupler preferably includes a shaft rotatable about a shaft axis transverse to the pedal axis, and a support element coupled to the shaft and providing off-axis support for each pedal during rotation of the shaft.

In one preferred embodiment the frame has a continuous upper surface with a pair of side-by-side elongate openings for receiving the pedals. The pedal is hingedly mounted to the frame near the heel. A motor is mounted on the frame for rotating the shaft. A cam or crank is mounted on the shaft for supporting each pedal between the toe and the hinged frame mounting. The cams or cranks associated with the pedals extend in radially opposite directions from the shaft so as to produce counter-reciprocating motion in the pedals during shaft rotation. A resistance device, such as a spring, fluid cylinder or ballast system or motor friction, provide resistance to downward movement of each pedal. A switch or other control is mounted relative to the frame adjacent to a pedal that is manipulable by a user's foot for controlling operation of the motor.

A particularly advantageous feature of this invention is that it provides equal and opposite movement of the user's two feet, thereby simulating a walking motion, balancing exercise and movement to the two feet and lower legs. In the preferred form, the invention may be used in a manual mode as a source of exercise, particularly when provided with a resistance device that requires some exertion by the user to press a pedal down. It may also be used in a passive or automatic mode in which the pedals are driven by an external source, such as a motor, hydraulic, pneumatic or other active system.

These and other features and advantages of the present invention will be apparent from the preferred embodiment described in the following detailed description and illustrated in the accompanying drawings.

DETAILED DESCRIPTION OF THE PREFERRED EMBODIMENTS OF THE INVENTION

Figure 1:
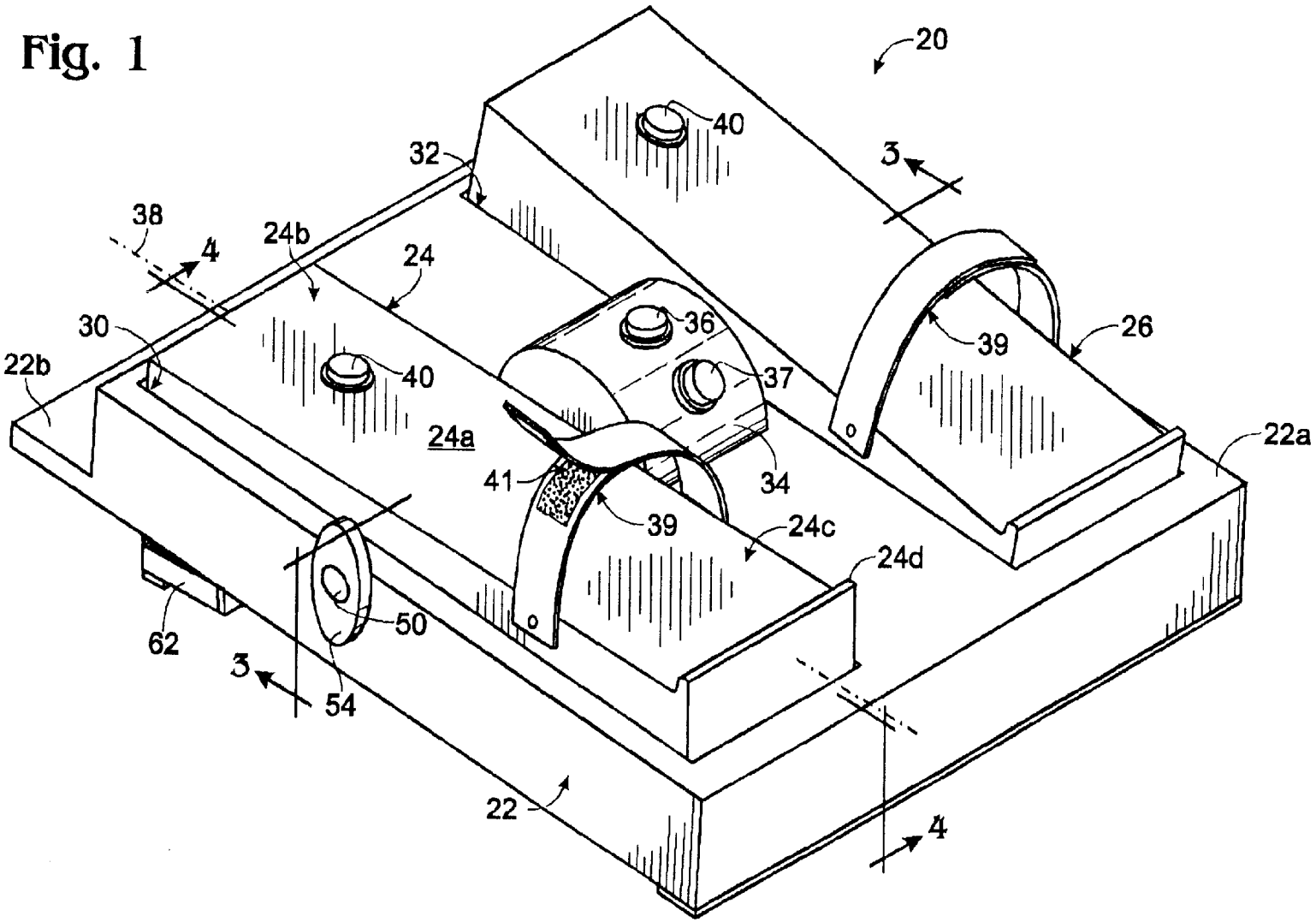
FIG. 1 is an isometric view of a first embodiment of the invention.

As has been mentioned, the invention provides for active extending and contracting of muscles of the lower extremities. An exerciser made according to a first preferred embodiment of the invention is shown generally at 20 in FIGS. 1–10. Exerciser 20 includes a frame 22, left pedal 24, right pedal 26 and a coupler 28 that couples action between the two pedals. In the preferred form shown, frame 22 forms a continuous enclosure that includes an upper surface 22*a* having openings 30 and 32 sized to freely receive the pedals, as shown. A motor cover 34 has mounted on it an on/off switch 36 and a high/low speed switch 37. These switches could be replaced with a rheostat or other forms of motor control.

In the embodiment shown, each pedal is box shaped having an open side facing downwardly. The upper surfaces of the pedals, such as surface 24*a*, are elongate and extend along a pedal axis, such as axis 38 between a toe end 24*b* and a heel end 24*c*. The shape of the pedals may also be made to conform to the shape of a foot or shoe, or a pad may be attached to the pedal surface which conforms to the shape of a foot or shoe. A ridge 24*d* extends upwardly at the heel end to help prevent the user's foot from slipping off of the pedal.

Each pedal also may have an adjustable foot strap attached to it, such as strap 39 shown on pedal 24. The strap preferably has two ends that are connected together by a quick closure fabric 41, such as that known commercially as VELCRO™ fabric. The straps can be used in the automatic mode of operation discussed below to hold the feet on the pedals through the full reciprocating motion of the pedals, as well as in the manual mode to apply an upward force on the pedals.

At least one and preferably both of the pedals also has a sensor switch 40, as is shown in the upper surface of pedals 24 and 26. The sensors witch senses when a user's foot is placed on the pedal. This switch preferably must be activated for the motor, described below, to operate.

Figure 2:
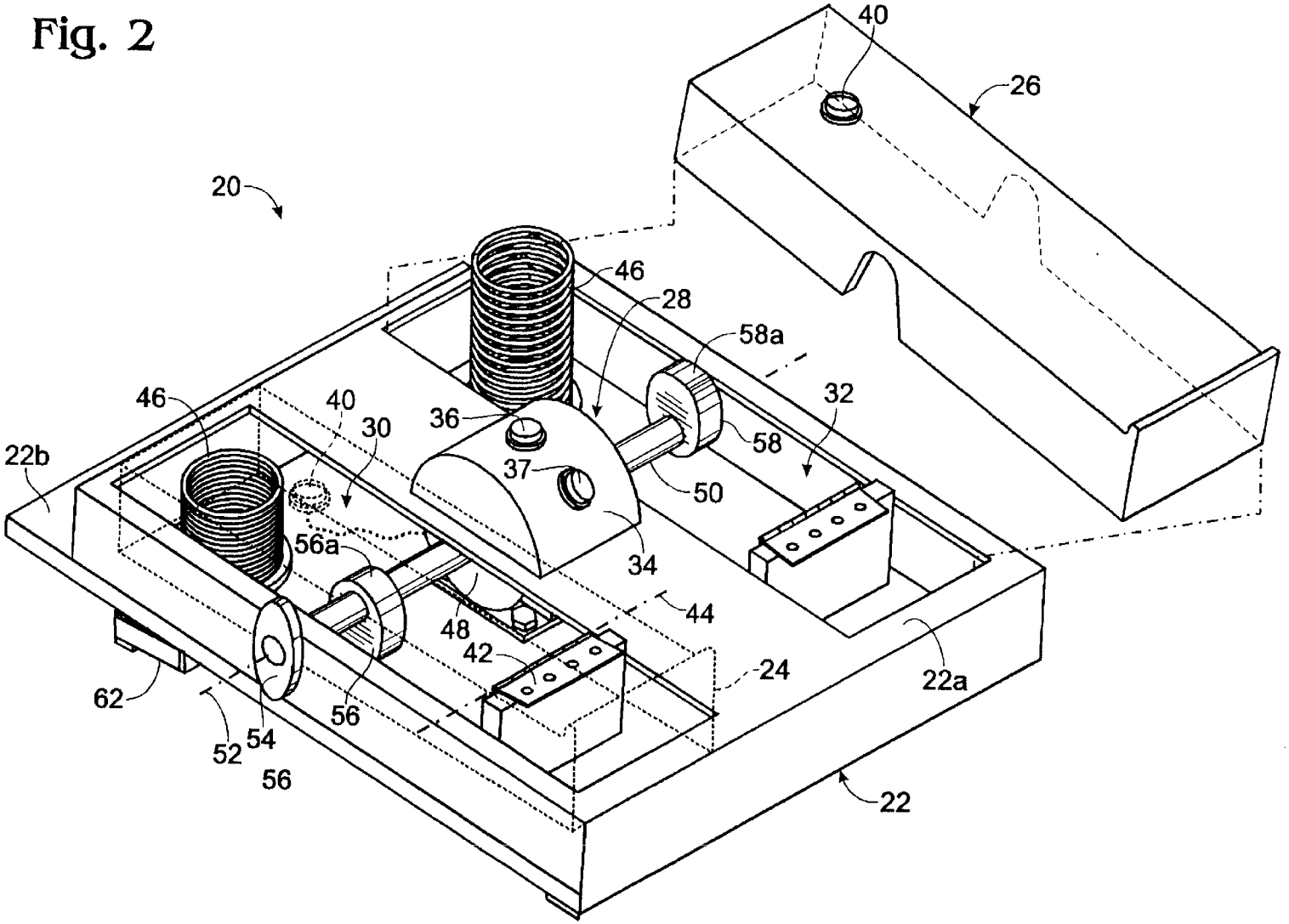
FIG. 2 is a view similar to FIG. 1 showing the foot pedals removed.
Figure 4:
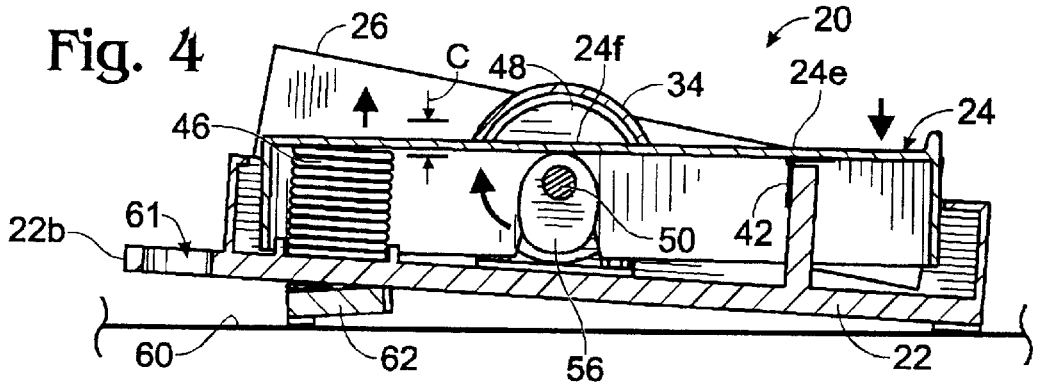
FIG. 4 is a simplified cross-section taken along line 4—4 of FIG. 1.

As shown particularly in FIG. 2, the heel ends of the pedals are pivotingly attached to the frame, as by hinge 42 attaching pedal 24 to the frame. The hinge is preferably positioned at what is referred to as a first or hinge position 24*e* on the pedal spaced from the heel end, as shown in FIG. 4. This provides pivoting of the pedal about a pivot or hinge axis 44, thereby causing both the toe and heel to move during operation.

The hinge axis is at least transverse, and preferably normal, to the pedal axis. As used herein, two axes are considered to be transverse or normal if they appear transverse or normal when viewed in a plane containing one of the axes that is parallel to or contains the other axis.

The hinge could also be placed at other positions along the pedal, including the very ends of the pedal, as desired. The hinge limits the pedal to a pivoting movement about the hinge. Other connecting devices could also be used which provide for movement about an axis spaced from the pedal, such as through use of a pivot arm or linkage assembly. The axis could also be made to move during operation to effect a hinging corresponding to the natural movement of the foot with a pivot axis above the pedal.

A resistance device is preferably provided to resist movement of the pedals during manual use of exerciser 10. A simple tension device is a spring, such as springs 46 shown positioned under the toe end of pedals 24 and 26. Each spring is preferably fixedly mounted to the pedal and the frame to help secure the pedal in the frame. A corresponding spring is shown under the toe end of each pedal. The springs preferably are selected to have an intermediate no-load position, such as the position of the spring shown in FIG. 5 when the pedals are even. This no load position is shown by line NL in FIG. 6. In this way force must be applied to the pedal for the lower half of the cycle of pedal reciprocation. Note that springs could also be placed under the heel ends or under both the toe and heel ends.

Figure 6:
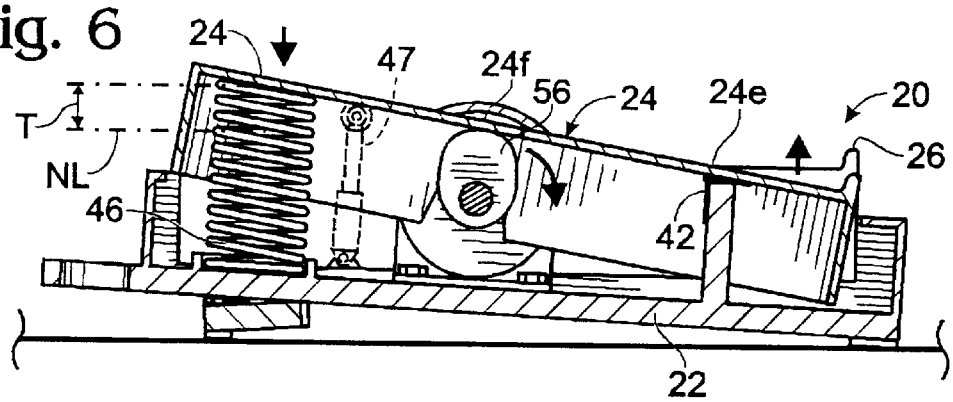

As will be described, other devices may be used which provide a continuous resistance during the full cycle of pedal reciprocation. One such device, shown in phantom lines in FIG. 6, is a conventional shock absorber-type of pneumatic cylinder 47 with a limited vent. The resistance is proportional to the size of the vent. Adjustability could be provided by adding a control, such as a valve, to vary the size of the vent. Cylinder 47 could also be part of a hydraulic cylinder system in which fluid travels between cylinders on each pedal. An alternative form of this could be activated by an electrical pump or pumps which would be activated by limit switches triggered by movement of the pedals. Such systems would replace springs 46. A shaft brake system is described below with reference to FIGS. 11 and 12.

Reciprocating pedal action is provided by coupler 28. In the embodiment shown in FIGS. 1–10, coupler 28 includes a motor 48 mounted on the frame between the pedals. Motor 48 is electrically driven to rotate a shaft 50 about a shaft axis 52. The shaft extends under both pedals and may be supported for free rotation relative to the frame, as appropriate. Preferably, the shaft extends to the walls of frame 22, as shown, where it is supported by respective bearings 53, shown particularly in FIG. 3. One of the ends extends through frame 22 and has a handle 54, also referred to as a lever, attached to it. The handle is preferably elongate and extends above the upper surface of the frame at least in selected orientations of the shaft as will be described.

Attached to the shaft below the pedals are cams 56 and 58. These cams, also referred to as support devices, are eccentrically attached to the shaft and extend in opposite directions from shaft axis 52, as shown in FIG. 2. Pedals 24 and 26 are supported on respective cams 56 and 58 at what are referred to as second positions, such as position 24*f* shown in FIGS. 4–7. The surfaces 56*a* and 58*a* of the cams that the pedals rest on, are referred to as pedal support surfaces. Note that the position shifts for different orientations of the cams during rotation. The cams are preferably elongate shaped, but also may have other shapes, such as circular.

Figure 3:
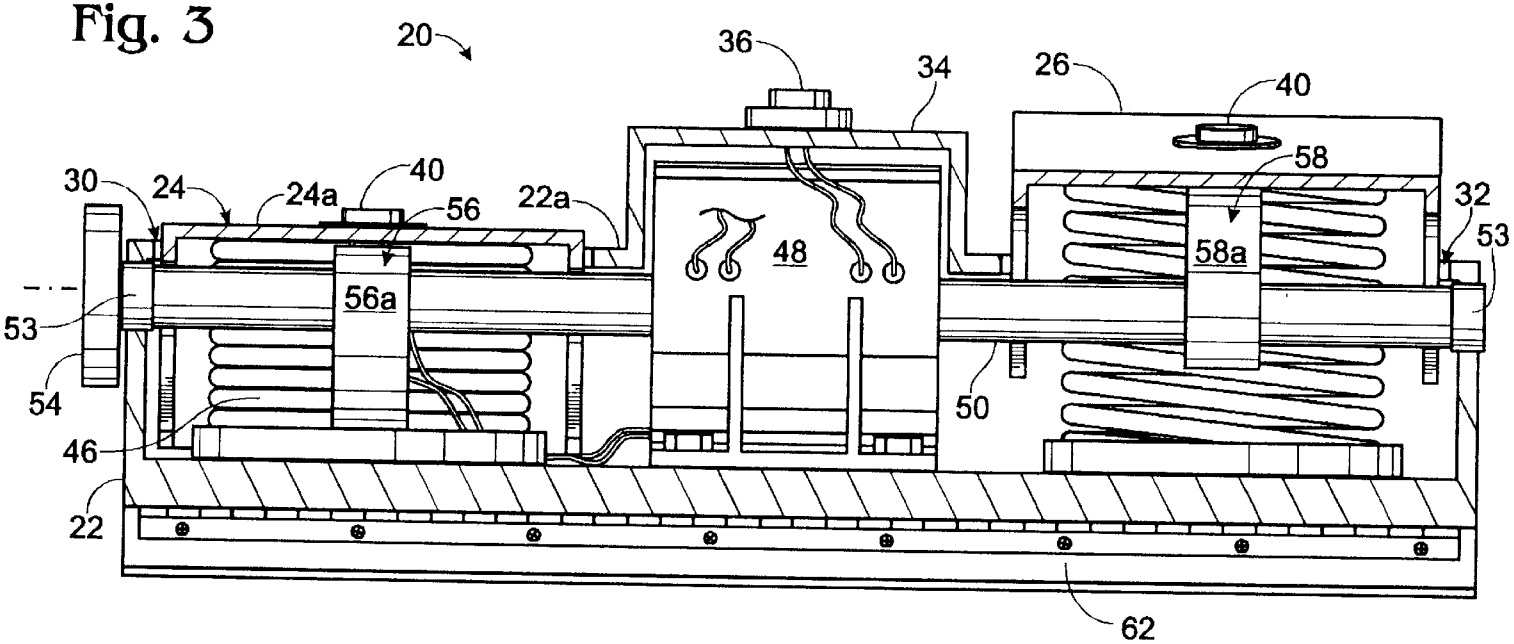
FIG. 3 is a cross-section taken along line 3—3 of FIG. 1.

FIGS. 4–7 illustrate the motorized operation of exerciser 20 when placed on a work surface 60, such as a floor. In FIG. 4, cam 56 extends downwardly, supporting pedal 24 in a low position. Although not shown in this drawing but as is shown in FIGS. 2 and 3, cam 58 extends upwardly, supporting pedal 26 in a high position. Spring 46 is in a compressed state, having been compressed by the distance C shown in FIG. 4.

The positions of the pedals are shown as they would be with a person's feet supported on them, thereby overcoming the force of the spring urging the pedal to the intermediate position. If the motor was running and there was no downward force on the pedals, the pedal, supported on the cams by gravity, would not move into the low state due to pressure of the spring. Also, any resistive force applied to the pedals by the springs must be overcome by the motor.

Figure 5:
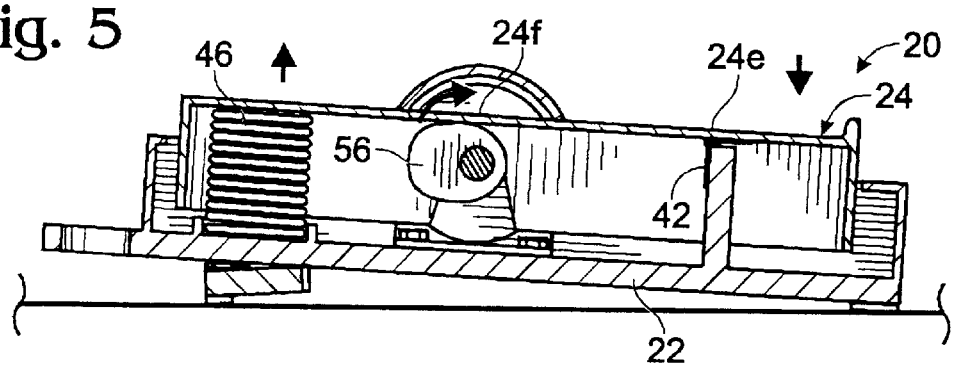
FIGS. 5–7 are views similar to FIG. 4 showing the embodiment of FIG. 1 in three other operative positions.

As the shaft rotates clockwise, as viewed in these figures, it reaches an intermediate position, shown in FIG. 5 in which cam 56 extends toward the toe end and cam 58 extends toward the heel end. The two pedals are in the same relative position when the cams are in this orientation, and the springs are in the no-load (NL) state.

Figure 7:
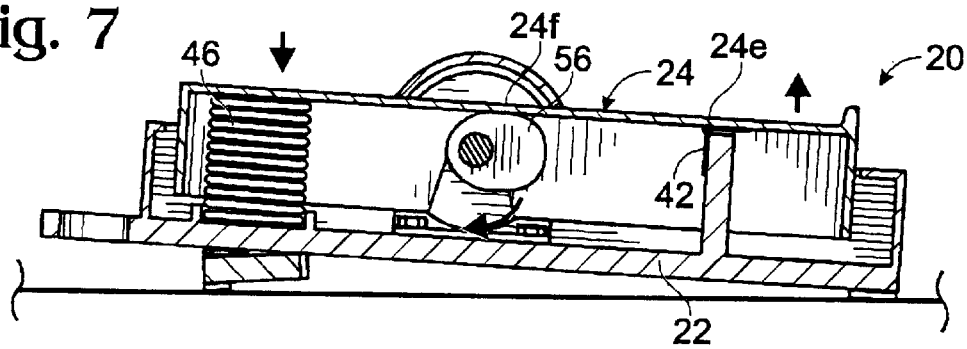

As the shaft continues turning, cam 56 reaches a high position and cam 58 reaches a low position supporting pedal 24 in a high position and pedal 26 in a low position. Spring 46 is in an extended state under tension. Further rotation of the cams brings them through a second intermediate position as shown in FIG. 7 and around to the position shown in FIG. 4, completing a full rotation of the shaft. It is seen that the pedals move in opposite tilting or reciprocating motion, referred to as counter-reciprocation motion due to the action of the cams on the pedals while the pedals move about the hinges that hold them to the frame.

As shown in FIG. 4, frame 22 also preferably includes an extension 22*b* extending beyond the toe ends of the pedals.

An opening 61 in the extension is sized to allow one's hand to easily be put through it, allowing the exerciser to be grasped for carrying.

Figure 8:
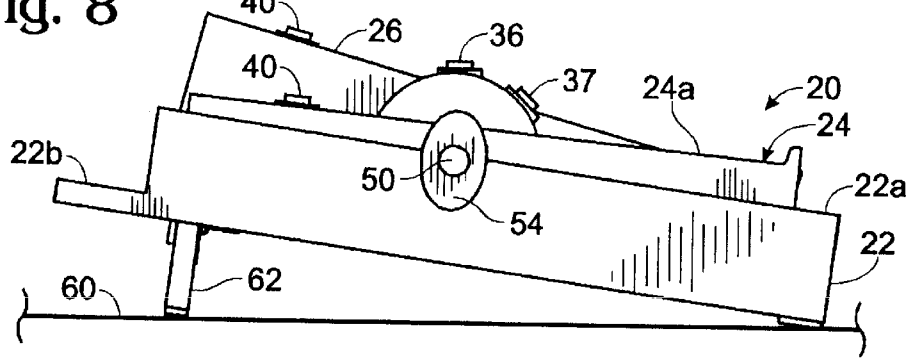
FIG. 8 is a side view of the embodiment of FIG. 1 showing the use of a swing-out leg.

Referring now to FIG. 8, hingedly mounted to the lower surface of frame 22 is a leg 62 extending the width of the frame under the toe end. In FIGS. 1–7, the leg is shown folded back next to the frame so that the pedals are disposed at a slight angle relative to a work surface, such as a floor, on which exerciser 20 is placed during use. If a user desires to have a greater angle for the pedals, the leg may be swung down to the position shown in FIG. 8.

Figure 9:
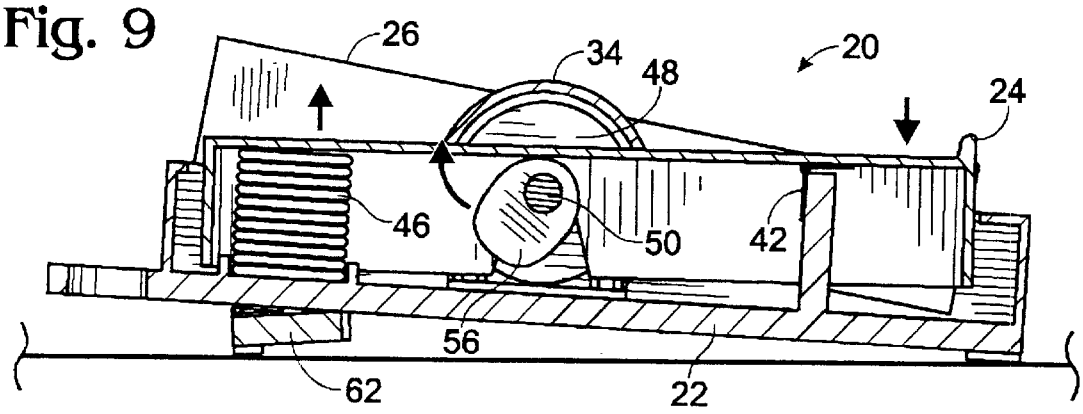
FIGS. 9 and 10 are views similar to FIG. 4 illustrating manual operation of the embodiment of FIG. 1.
Figure 10:
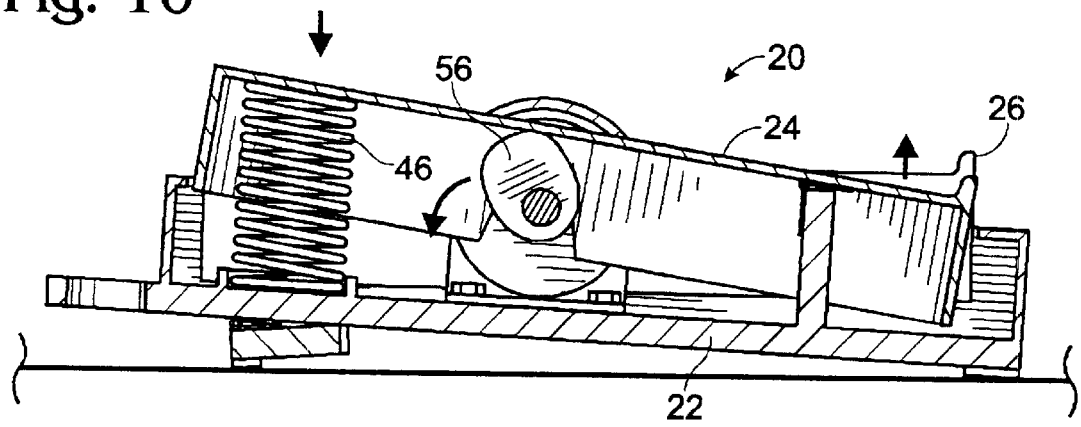

Manual operation of exerciser 20 is illustrated in FIGS. 9 and 10. It is possible that the shaft will be in a position shown in FIG. 4 or FIG. 6 when manual operation is initiated. Manual operation is effected by pressing down on the higher pedal. If the higher pedal is supported on the very top of the cam, downward force on the pedal may not cause the cam to rotate. Handle 54, shown at one end of the shaft although it may also be located in other places, such as next to the motor, preferably extends above the surface of the adjacent pedal when a cam is in this upright position. Rotational movement of the handle, such as by the foot of the user, causes the cam to shift off-center, thereby permitting downward rotation of the cam when pressure is applied to the higher pedal.

FIG. 9 shows the rotational position of cam 56 when cam 58 (not shown), the higher cam, is positioned off-center. Downward pressure applied by the user to pedal 26 causes cam 58 to rotate downwardly clockwise, as viewed in this figure, and cam 56 to rotate upwardly, raising pedal 24. When the lowest position of cam 58 is reached, cam 56 is in the highest position it will reach, as shown in FIG. 10.

The user then applies downward pressure on pedal 24 causing it to force cam 56 to rotate counterclockwise to the low position shown in FIG. 9, after which the cycle is repeated. It will be seen that the motion of the pedals is not as great as when shaft 50 is being turned by motor 48. Further, rather than rotating the shaft continuously in one direction, the shaft reciprocatingly rotates back and forth over an arc of less than 180°, as shown. The length of the, arc depends on the shape of the cam in this embodiment. If a different type of coupler were used, such as a hydraulic system that raises one pedal as the other pedal is depressed, then movement of the pedals would be very similar to that provided when externally powered.

Further, it will now be appreciated that a user could provide a natural resistance to movement of the pedals simply by the weight of the foot in the lower position. Movement of the higher pedal downwardly raises the lower pedal that supports the associated foot. Thus, some exercise is provided in this way. The resistance devices add further resistance to movement of the pedals as discussed above. This increases the amount of force that a user must apply to move a pedal to its lowest position.

If a continuous resistance device is used, such as a conventional pneumatic shock absorber 47 shown in FIG. 6, then force must be applied for any downward movement of the higher pedal. Shock absorber 47 provides resistance when it is being elongated as well as when it is being shortened. In such an exerciser it would also be possible to increase the range of exercise by using foot straps 39 on the pedals, as is shown in FIG. 1. A user then may also get exercise by pulling upwardly on a lower pedal. Any number of shock absorbers could be used, even just one, since the coupler causes counter-reciprocating motion between the pedals. When there is resistance to downward movement of one pedal, there is a corresponding resistance to upward movement of the other pedal.

Figure 11:
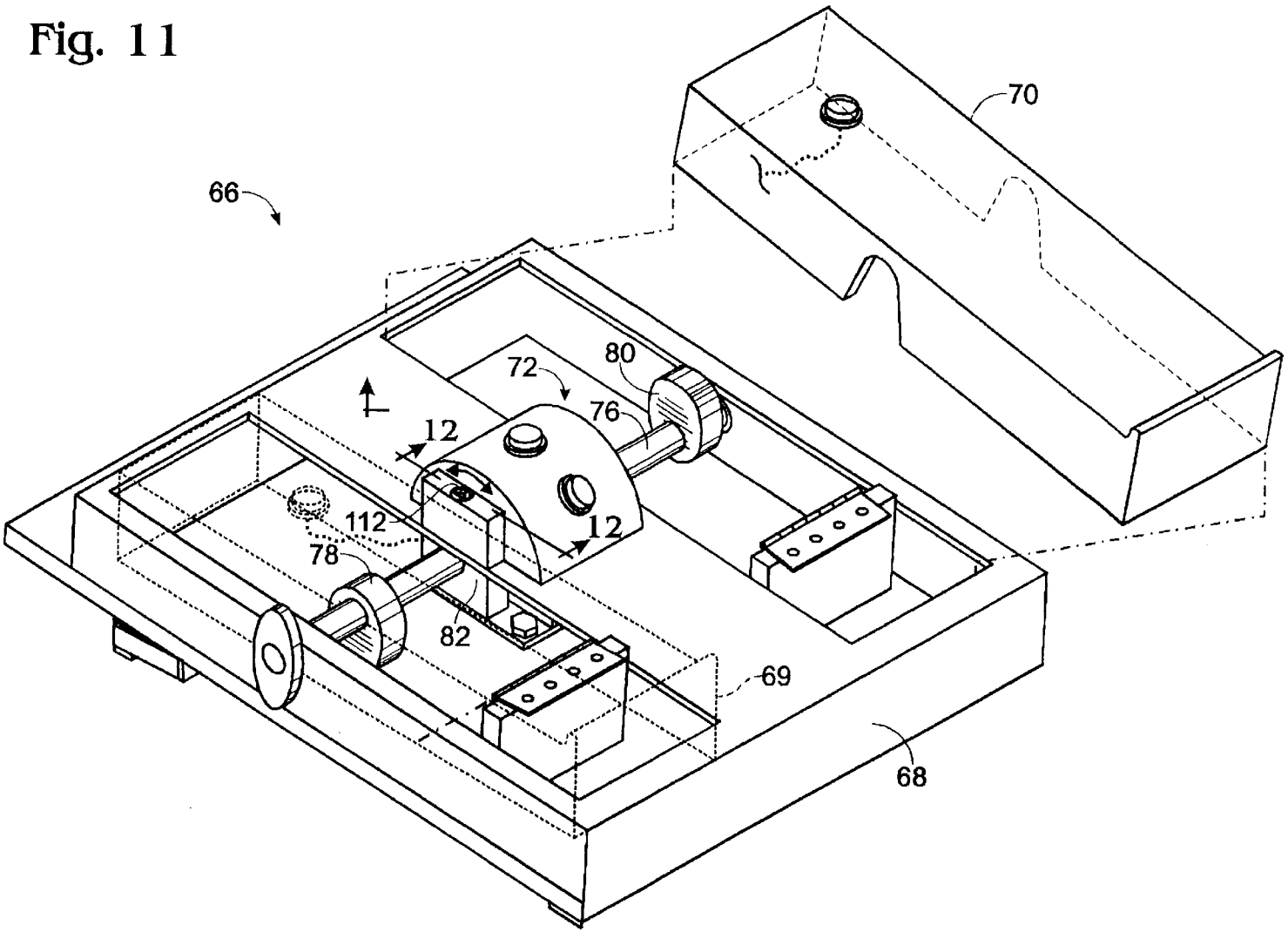
FIG. 11 is a view similar to FIG. 2 illustrating a second embodiment of the invention.
Figure 12:
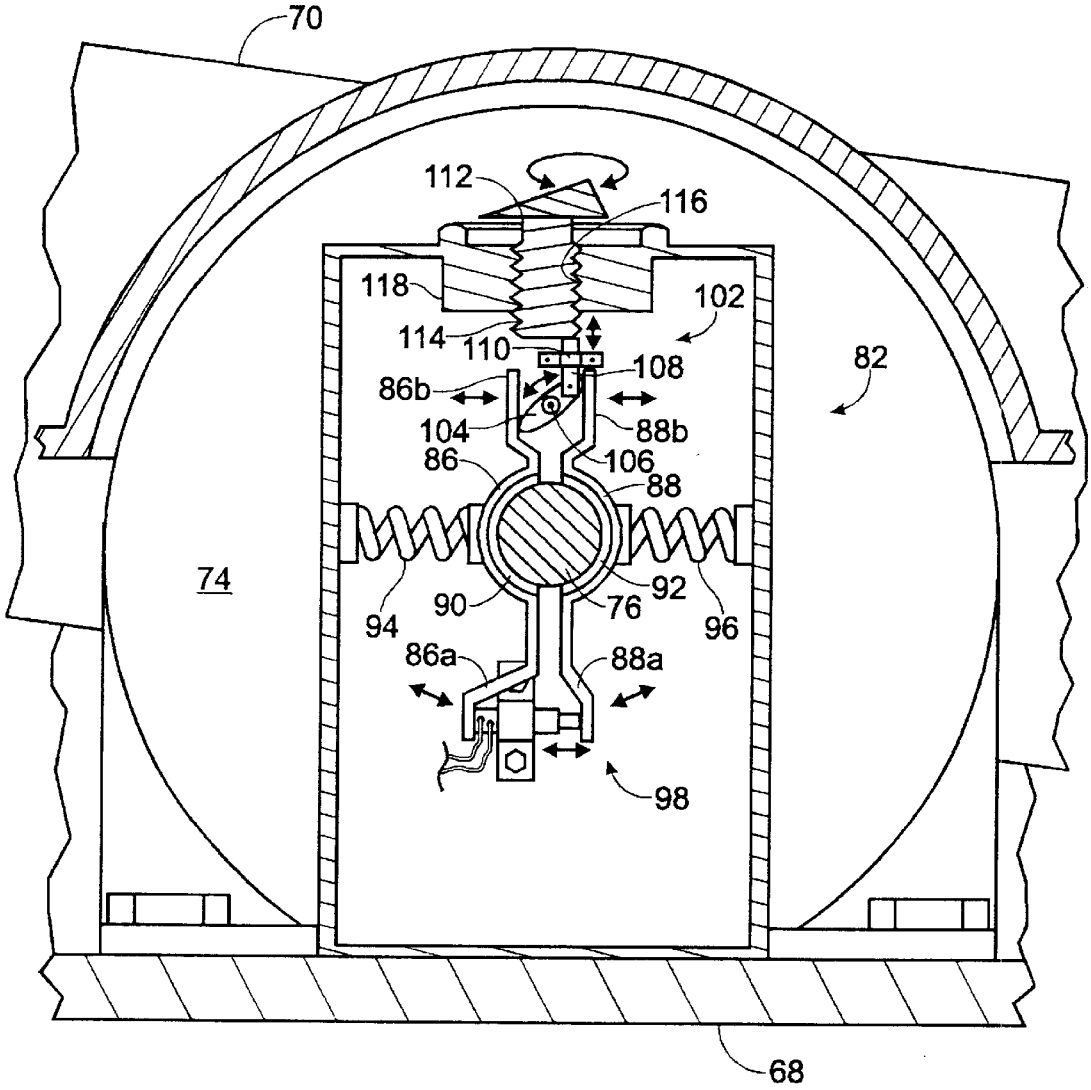
FIG. 12 is a partial cross section taken along line 12—12 in FIG. 11.

FIGS. 11 and 12 illustrate a second embodiment of the invention that provides for variable resistance to pedal motion. An exerciser 66, generally similar to exerciser 20, includes a frame 68, right pedal 69, left pedal 70, and coupler 72. Coupler 72 includes a motor 74, rotating shaft 76, and cams 78 and 80.

Exerciser 66 also includes a resistance device in the form of a variable shaft brake assembly 82. The brake assembly may be installed anywhere along the shaft. It is preferred to have it next to the motor between the pedals as shown. Assembly 82 includes a housing 84 built around the shaft. A pair of opposing brake shoes 86 and 88 partially surround shaft 76. Pads 90 and 92 are respectively disposed between the shoes and the shaft, as shown. Springs 94 and 96, mounted between the housing and shoes, respectively urge the shoes toward the shaft with sufficient force to provide resistance to rotation of the shaft.

Disposed below the shaft is an automatic release 98 that includes a solenoid 100 extending between the ends of arms 86*a* and 88*a*. The arms are in the closed position shown when the motor is not running, but are separated when the motor is running.

Disposed above the shaft is a manual release 102. Release 102 includes a cam 104 supported for rotation relative to housing 84 on a pin 106. The orientation of the cam is controlled by a rod 108 pivotingly mounted to one end of the cam, as shown and vertically slidably held in a sleeve 10. The sleeve is also mounted to housing 84. The vertical position of the rod is manipulated by a manually turned dial 112 mounted on the top of the housing. The dial rotates a threaded bolt 114 the bottom of which is seated against the top of rod 108. Bolt 114 is matingly received in the threaded bore 116 passing through a block 118 positioned in the top of the housing.

Cam 104 is continuously biased toward a more upright position due to the pressure of brake shoe arms 86*b* and 88*b* which extend up from shaft 76, as shown. Clockwise rotation of the cam, as viewed in the figure, causes the arms to be separated, reducing the friction on the shaft. Counterclockwise rotation resulting from upward movement of bolt 114 is caused by the pressure of the arms on the cam.

It will be appreciated that shaft brake assembly 82 is a resistance device that provides manually variable friction to the shaft regardless of the direction or extent of shaft rotation. It also provides for deactivation of the resistance device when the motor is running.

Exerciser 20 or 66 is operated by a person sitting in an appropriate chair in an upright sitting position. The feet are placed upon the foot pedals which are positioned directly below the feet, with the toes higher than the heels. In either the manual or automatic (motor-driven) modes of operation, the feet alternately move with the pedals in a rhythmic and continuous manner. The toe of the right foot presses downward as the heel rises, and the heel of the left foot presses downward with the toe of the left foot rising, simultaneously. The process is then reversed.

This rhythmic motion allows the muscles of the foot, calf and upper thigh to flex and extend alternately. The amount of tension or resistance experienced by the operator could be made adjustable by the user, such as a vent valve on a pneumatic cylinder. In the manual mode, the operator forces the pedals through the described motion. In the driven mode, the operator relaxes and allows the exerciser to move the feet through the described motions. In this mode, it may be helpful to strap the feet to the pedals in order to assure that the feet are moved through the full range of motion. Preferably controls are provided for turning the motor on or off, varying the motor speed, such as with a rheostat, and varying the resistance, that are manipulable by the feet. It is also preferable to use a resistance device that can be inactivated or is automatically inactivated during operation in the driven mode. This allows the operator freedom to type, read and work while the exerciser moves the feet.

Whether used in manual or driven modes, the exerciser simulates a pumping motion up and down, alternating between the feet. The operator flexes and extends one foot while contracting and flexing the other in the opposite direction.

The pedals preferably extend through openings in a frame and have sides that generally conform to the shape of the openings to reduce the likelihood of foreign objects or the operator's fingers from getting into the working parts under the pedals. The upper surfaces of the pedals also preferably are above the upper surface of the frame in all positions, thereby allowing operators with large feet or shoes to use the exerciser without limitation.

It is seen that an exerciser made according to the invention provides counter-reciprocating motion, very similar to the natural walk of a user. Further, the pedals are caused to pivot during reciprocation causing extending and contracting of foot and lower leg muscles. This is accomplished with the feet moving very little in forward or backward directions, increasing the comfort of use, and allowing use in confined areas, such as under an office desk. Such an exerciser may be made with a relatively simple design that is inexpensive to construct and has a small size that is portable and easily fits into small spaces.

Although the present invention has been described in detail with reference to particular embodiments, persons possessing ordinary skill in the art to which this invention pertains will appreciate that various modifications and enhancements may be made without departing from the spirit and scope of the claims as written and as judicially construed according to principles of law.

In particular, various forms of coupler may be used. A motor with a rotating shaft is illustrated. It could also be a fluid-based system, such as a hydraulic or pneumatic system in which fluid flows between cylinders under the two pedals. A chain or mechanical linkage system could also used. The shaft could be attached to cranks that are attached to the pedals.

As have been mentioned, various types of resistance devices are also possible. These also could be based on hydraulic, pneumatic, motor or friction devices. A combination spring/pneumatic cylinder assembly or even a resilient foam could also be used. The amount and nature of pedal movement can be varied to suit the intended use of the exerciser. The relative locations of the support of the pedals on the frame and on the coupler can be varied, as well as the size and shape of the crank, cam or other motion-imparting element.

The above disclosure is thus intended for purposes of illustration and not limitation.

The invention claimed is:

1. An exerciser comprising:

a frame positionable on a work surface;

a pair of elongate pedals mounted in side-by-side relationship, each pedal having a toe end, a heel end, and an upper pedal surface extending along a pedal axis for supporting a foot of a user, the pedal being mounted at a first position to the frame in a manner limiting the pedal to movement about a pivot axis transverse to the pedal axis; and a coupler mounted relative to the frame for supporting each of the pedals at a second position being spaced from the respective first position, the coupler moving the second position of one pedal upwardly when the second position of the other pedal moves downwardly, the coupler comprising a shaft rotatable about a shaft axis transverse to the support axis, and a support element coupled to the shaft and having a coupler support surface spaced from the shaft axis for supporting each pedal during rotation of the shaft.

2. An exerciser according to claim 1 wherein the support element is a cam.

3. An exerciser according to claim 2 further comprising a lever attached to the shaft for manually rotating the shaft.

4. An exerciser according to claim 1 further comprising a resistance device for resisting movement of at least one pedal wherein the resistance device is a brake applied to the shaft.

5. An exerciser according to claim 1 further comprising a motor for applying a force tending to rotate the shaft in a given direction and a switch mounted to a pedal for contact by a foot supported on the pedal surface, the switch controlling operation of the motor.

6. An exerciser according to claim 1 further comprising a resistance device for resisting movement of at least one pedal wherein the resistance device is a spring positioned between the frame and the one pedal.

7. An exerciser according to claim 1 further comprising a resistance device for resisting movement of at least one pedal wherein the resistance device is a fluid cylinder positioned between the frame and one pedal.

8. An exerciser comprising:

a frame positionable on a work surface and having a continuous upper surface having a pair of side-by-side elongate openings;

an elongate pedal received in each frame opening, having a toe end, a heel end, and an upwardly facing pedal surface extending along a pedal axis for supporting a foot of a user, the pedal being mounted to the frame at a first position between the toe and heel ends for pivoting about a pivot axis that is normal to the pedal axis; and a shaft rotatable about a shaft axis extending normal to the pedal axis;

a motor mounted on the frame for applying a force tending to rotate the shaft in a given direction;

a support device coupled to the shaft for rotation with the shaft and having a pedal support surface spaced from the shaft axis supporting each pedal at a second position spaced between the first position and the toe end during rotation of the shaft, the pedal support surfaces of the respective support devices that are contacted concurrently by the respective pedals being positioned different distances from the shaft axis for producing counter-reciprocating motion of the pedals during rotation of the shaft;

a resistance device for resisting downward movement of each pedal; and a switch mounted relative to the frame adjacent to a pedal for controlling operation of the motor.

* * * * *